United States Patent [19]

Maskell

[11] 4,027,707

[45] June 7, 1977

[54] VACUUM CHAMBER STRUCTURE AND CONTROL SYSTEM THEREFOR

[75] Inventor: Richard N. Maskell, Bloomingdale, Ill.

[73] Assignee: Container Corporation of America, Chicago, Ill.

[22] Filed: May 14, 1976

[21] Appl. No.: 686,285

[52] U.S. Cl. ..... 141/66; 53/84; 53/85; 53/86

[51] Int. Cl.[2] ..... B65B 31/02

[58] Field of Search ..... 53/84, 85, 86; 141/65, 141/66

[56] References Cited

UNITED STATES PATENTS

| | | | |
|---|---|---|---|
| 1,125,138 | 1/1915 | Lorenz et al. | 53/85 |
| 3,220,157 | 11/1965 | Buchner | 53/86 |
| 3,377,769 | 4/1968 | Bridgeman | 53/84 |
| 3,597,897 | 8/1971 | Gerard | 53/84 |
| 3,714,754 | 2/1973 | Holcombe et al. | 53/84 X |

*Primary Examiner*—Travis S. McGehee
*Attorney, Agent, or Firm*—Carpenter & Ostis

[57] ABSTRACT

A system for evacuating selectively two side-by-side chambers having a common wall with a pressure passageway therein includes a closure slidable between two positions where one chamber is connected to subatmospheric pressure with the common pressure passageway while the other is connected to ambient, and including circuit means for controlling the application of pressure and the release of same.

7 Claims, 6 Drawing Figures

VACUUM CHAMBER STRUCTURE AND CONTROL SYSTEM THEREFOR

BACKGROUND OF THE INVENTION

1. Field of the Invention

This invention relates to structure for selectively reducing the pressure within a pair of side-by-side chambers having a common central supply passageway, a slidable closure being movable between two operative positions determining which of the two chambers is subject to the reduced pressure at the common passageway. Each chamber is arranged with mechanism for sealing a flexible walled container therein after the contents therein have been subjected to sub-atmospheric pressure for removal of air from such contents, and structure is provided for controlling the application of the less than atmospheric pressure to the chamber being evacuated to prevent surging of a very slight pulverulent material within the flexible walled container. As another adjunct to the invention the evacuated chamber may be back flushed with an inert gas to a predetermined pressure.

2. The Prior Art

Structures for creating a condition within one of two side-by-side walled chambers are known, for example, in alternate heating and cooling of the chambers by redirecting heating gases. The following patents are illustrative of such structures:

| | |
|---|---|
| Frank | 134371 |
| Murphy | 1560287 |
| Moll | 1849242 |

Patents for reducing pressure below ambient to fill a vessel are exemplified in the following:

| | | |
|---|---|---|
| Duncan | RE23544 | 119/14.09 |
| Hapgood | 2006393 | 226/116 |
| Weaver | 2428598 | 226/116 |
| Carter | 2538411 | 316/31 |
| Pechy | 2760702 | 226/68 |

SUMMARY OF THE INVENTION

According to the present invention there is provided a pair of side-by-side chambers having a common wall with a pressure passageway therein cooperating with a sliding closure selectively connecting one chamber or the other to the pressure passageway for purposes of evacuating the chambers selectively. Evacuation is under control of a circuit which applies sub-atmospheric pressure at a lower initial rate, evacuates the chamber in a timed cycle, flushes the evacuated chamber with an inert gas, heat seals the flexible walled container and connects the evacuated chamber to ambient.

THE DRAWINGS

Figure 2:
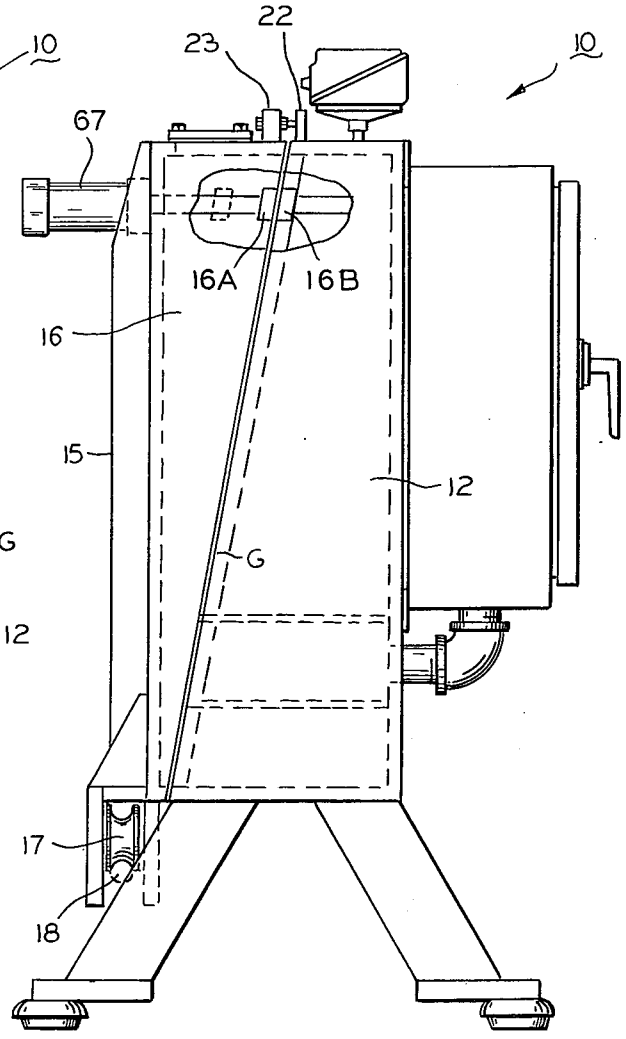
FIG. 2 is a side elevational view thereof.

The system according to the present invention is denoted generally by the reference numeral 10 and includes a pair of side-by-side walled chambers 11 and 12 having a common wall 13 therebetween. A passageway 14 in common wall 13 is connected selectively to chamber 11 or 12.

The chambers 11 or 12 are adapted to be closed selectively to ambient for evacuation of the chambers by a closure 16 provided with spaced rollers 17 along the lower edge thereof, rollers 17 being guided along a lower rail 18 supported at its ends on spaced frames 19 and 21 which also support the walled chambers 11 and 12.

A gasket G is supported on closure 16 and is arranged to seal closure 16 to its correlative chamber 11 or 12.

It will be noted that the dimensions of closure 16 are such that it overlaps common wall 13 whether in position to close chamber 11 or 12 and in such a fashion that passageway 14 is always connected to one or the other of chambers 11 or 12. Closure 16 is provided with a hand hold 15 whereby it may be shifted from one operative position to another.

Figure 6:
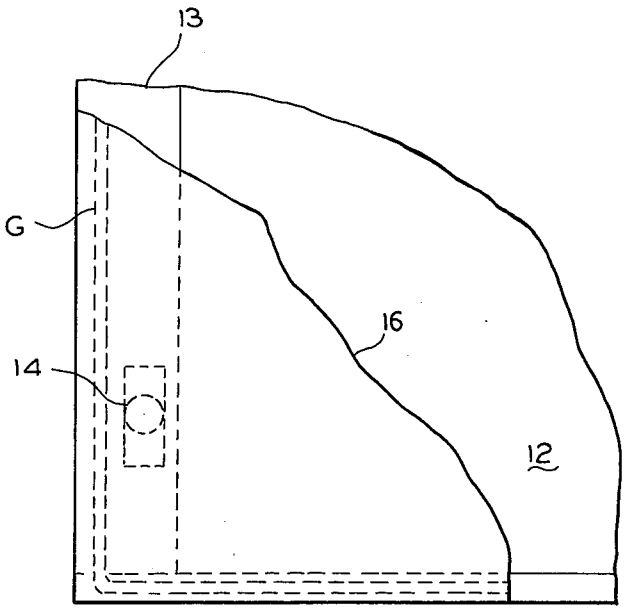
FIG. 6 is a sectional view on an enlarged scale showing vacuum inlet in the other chamber.
Figure 5:
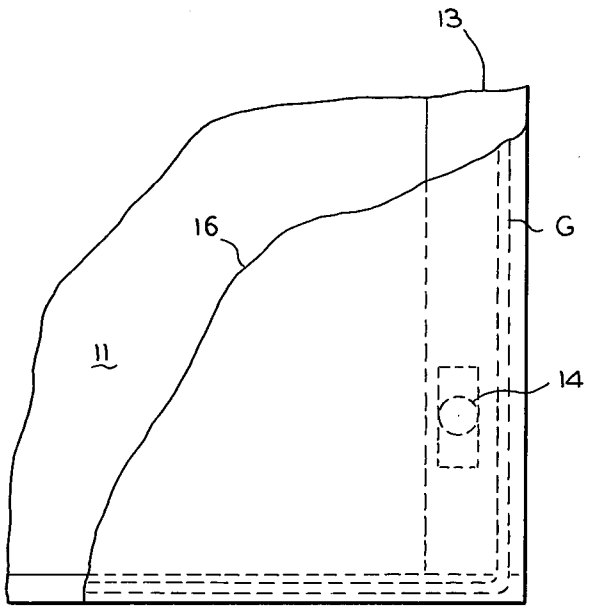
FIG. 5 is a sectional view on an enlarged scale showing vacuum inlet in one chamber.

FIGS. 5 and 6 illustrate the use of the door 16 as valving means. FIG. 5 illustrates vacuum inlet located totally in the chamber 11 with the gasket G located in the door, the door 16 being positioned as shown. Similarly, FIG. 6 shows vacuum inlet totally in the chamber 12 with the gasket G located in the door, the door 16 being positioned as shown and acting as valving means.

Each of the chambers prior to closing is arranged to receive a shipping container SC containing a product, not shown, held within a liner of flexible material FM therein. Shipping container SC is provided with closure flaps CF which are folded down against the sides of container SC. Liner FM has its upper portion extending above the upper parts of container SC and is adapted to be sealed along the top edges thereof along a sealing line SL.

The product to be enclosed within liner FM which may be powdered or of a type with voids therein, such as small fruits, is evacuated by vacuum in conjunction with the evacuation of chamber 11 or 12 and at the conclusion of the evaculation, the liner FM is bar sealed along sealing line SL by a sealing device indicated generally by symbol S. Sealing is done while the container SC and its liner FM together with contents are within the chamber 11 or 12 during the evacuating process and at the conclusion thereof the pressure within the chamber is restored to ambient. Details of structure S for such purpose form no part of the present invention except that it includes a movable heat sealing bar 16A movable with respect to closure 16 and against fixed sealing or back up bar 16B each mounted fixedly within chamber 11 and 12.

Structure is provided for controlling the application of sub-atmospheric pressure to the chambers 11 and 12 selectively when closed. Such structure is operable when the closure 16 is in operative position and includes circuitry for controlling the rate of application of sub-atmospheric pressure to prevent surging of very light and powdery material, for example, and for controlling restoration of ambient pressure at the conclusion of the evacuating process. In addition, structure may be provided for back flushing an evacuated chamber with an inert gas, such as nitrogen, to a predetermined pressure to reduce the amount of oxygen in contact with the packaged product and to maintain a proper pressure within the liner FM to prevent crushing of the packaged product.

Figure 3:
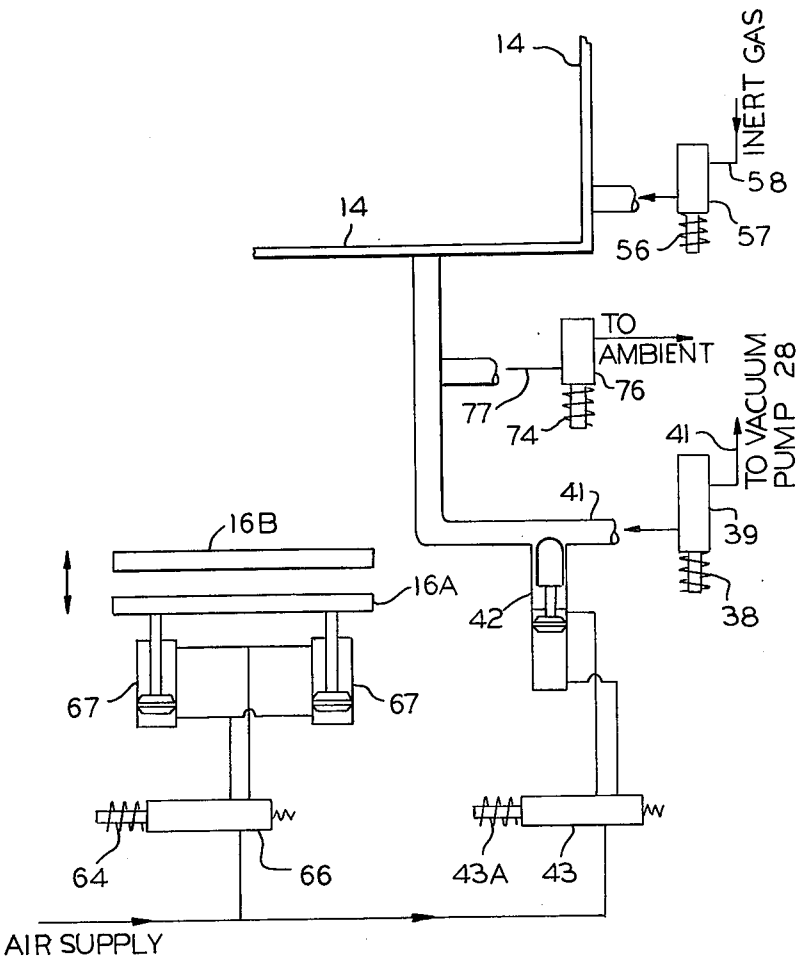
FIG. 3 is a schematic view showing an evacuating system for the structure of FIGS. 1 and 2.
Figure 4:
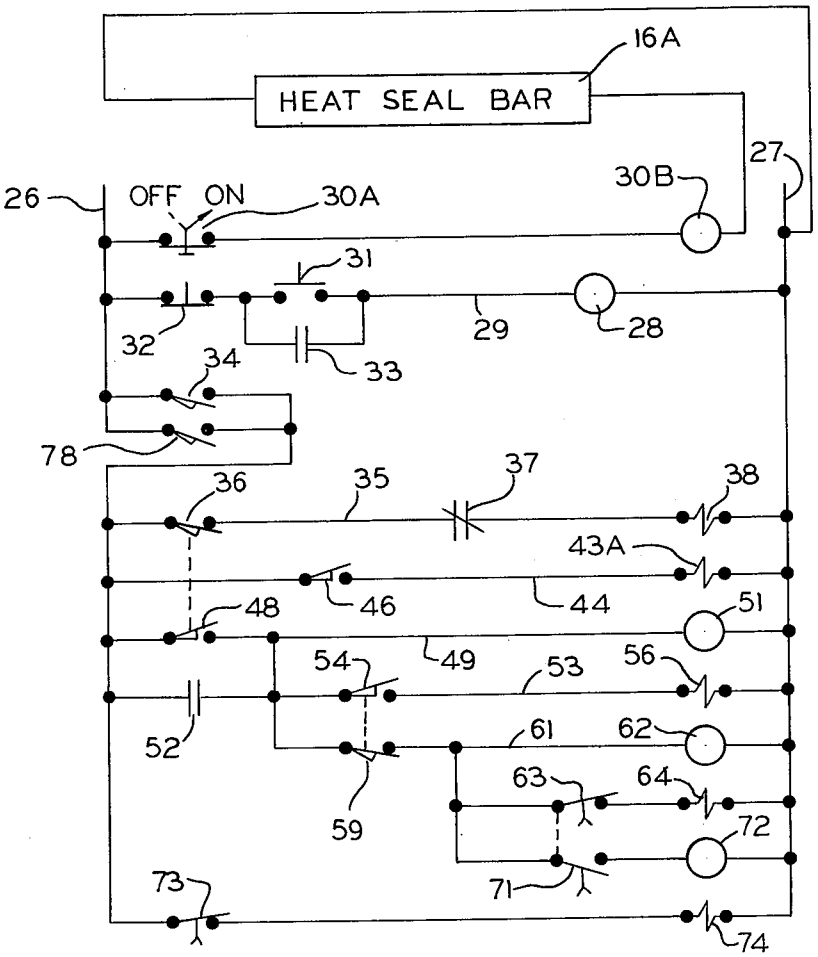
FIG. 4 is a schematic view showing a control circuit for the apparatus of FIGS. 1 and 2.

Such control circuitry is best seen with reference to FIGS. 3 and 4. As seen in FIG. 4 a pair of power leads 26 and 27 supply power to a vacuum pump 28 connected across leads 26 and 27 in a line 29 having a start switch 31 and a stop switch 32 connected in series therein, start switch 31 having a holding contact 33 connected therein.

Figure 1:
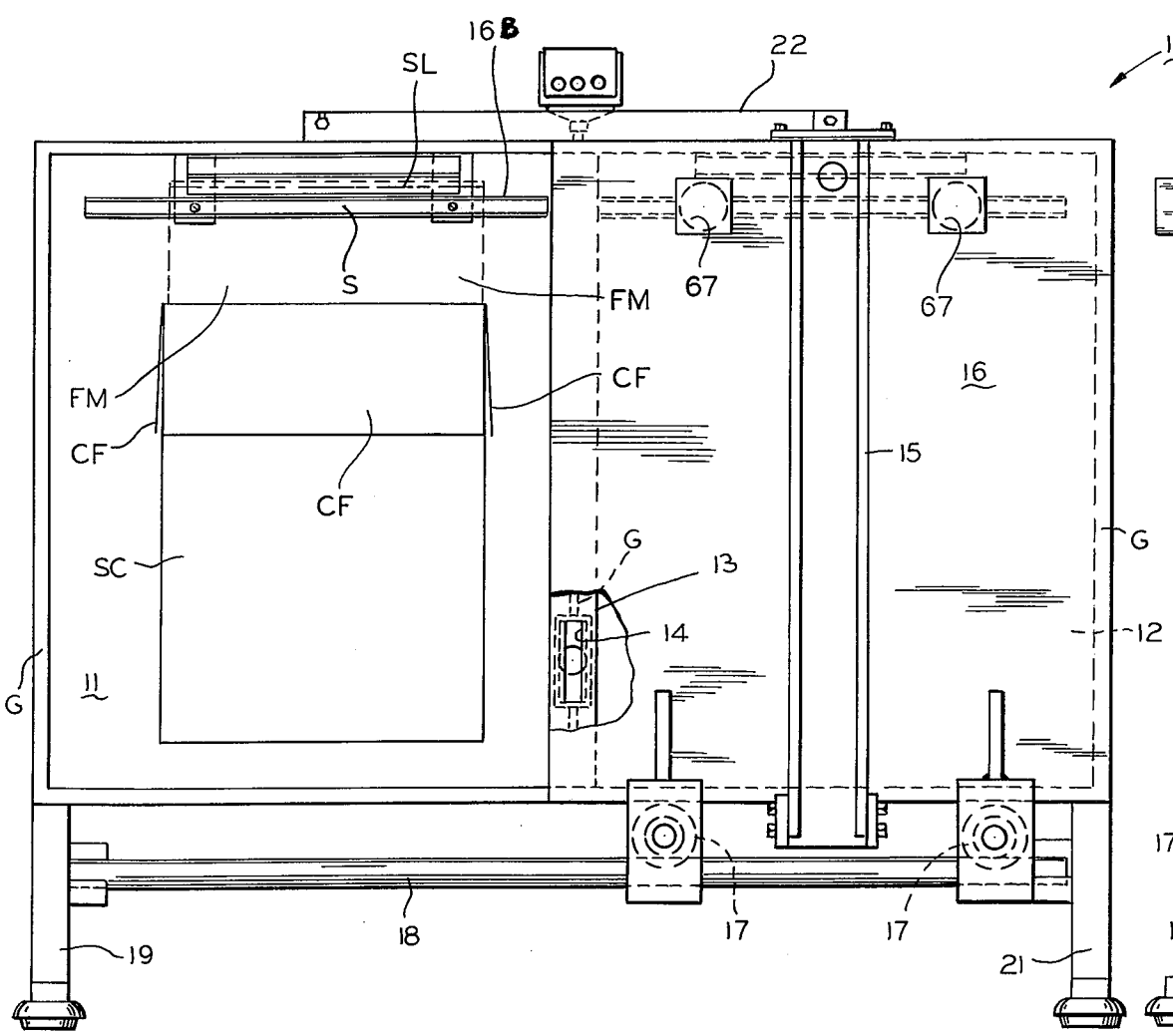
FIG. 1 is a front elevational view of a chambered vacuum apparatus adapted for use in the system according to the present invention.

At the start of a sealing operation the operator first places an on-off switch 30A into the "on" position seen in FIG. 3 to energize the heat seal bar 16A; see FIGS. 1 and 2. The supply of energy thereto being controlled by a thermostat 30B.

The operator then places a product within liner FM in turn supported within container SC and in turn within chamber 11 or 12.

Consider the conditions obtaining when closure 16 is closed on left chamber 11. At such time a left position door limit switch 34 is closed in lead 26, and a circuit is made through a line 35 containing a normally closed high vacuum limit switch 36, a normally closed relay contact 37, a solenoid 38 for solenoid controlled valve 39, see FIG. 3, connected in a vacuum line 41 to the passageway 14 in wall 13.

A throttling valve 42 is interposed in line 41, it being controlled by a solenoid operated valve 43 having its solenoid 43A connected in lead 44 between power leads 26 and 27. A low vacuum limit switch 46 is connected in lead 44, and is closed when the vacuum in line 41 is at a low level, and throttling valve 42 at such times is operable to control the rate at which subatmospheric pressure is placed upon passageway 14 and in turn chamber 11 or 12 to prevent surging of the contents in the liner FM. Line 41, it will be remembered, is now connected to chamber 11 via passageway 14.

When low vacuum limit switch 46 is closed by reason of a certain vacuum level being reached, the rate of vacuum application is increased since surging is now largely prevented. When switch 46 is closed solenoid 43A is energized and throttle valve 42 no longer operates to throttle the rate of vacuum application.

When the vacuum level in chamber 11 reaches a desired high value a switch 48 mechanically connected as shown to switch 36 closes, switch 36 now opening. With switch 36 open, valve 38 is deenergized and the application of vacuum to chamber 11 now ceases.

At this time, with switch 48 closed in a line 49, a control relay 51 will be energized to open now closed contacts 37 in line 35 and close contacts 52 in a line 53 connected between power leads 26 and 27. Contact 52 is arranged to maintain relay 51 energized to hold open contacts 37 to maintain solenoid 38 for valve 39 deenergized. Vacuum is no longer now applied to chamber 11 but is maintained therein.

At the time contacts 52 are closed, a gas flush limit switch 54 connected in line 53 is now closed, it closing when an upper vacuum limit in chamber 11 is reached. When switch 54 is closed, a solenoid 56 operating a gas flush valve 57 is energized to introduce an inert gas via line 58 connected to valve 57 into passageway 14 and to chamber 11.

As the vacuum in chamber 11 is lessened by the introduction of inert gas flushing gas switch 54 opens. It is mechanically connected as seen in FIG. 4 to a swtich 59 connected in a line 61 and in series with a time delay relay 62.

Switch 59 is also connected in series with a normally closed switch 63 operated by time delay relay 62 and connected in series with a solenoid 64 actuating a valve 66 controlling cylinders 67 advancing and retracting sealing bar 16A closing upper extremities of liner FM to provide a seal line SL. Switch 63 and solenoid 64 are connected in parallel with time delay relay 62.

Time delay relay 62 also controls a normally open switch 71 mechanically connected to switch 63 having an aeration time delay relay 72 connected in series therewith. Switches 71 and relay 72 are in parallel with switch 63 and solenoid 64. When switch 71 closes, the sealing operation is completed and the chamber 11 restored to ambient pressure. Such restoration is delayed, however, by the aeration delay relay 72 which controls a pair of contacts 73 which close upon decay of relay 72. Contacts 73 are in series with a solenoid 74 operating a valve 76 connected to a line 77 in turn connected to line 41.

At this time the cycle described is complete and the same set of operations can be had with chamber 12 by shifting of closure 16 to close said chamber. At such time a door limit switch 78 is closed, it being in parallel with switch 34 and upon closing controlling the sequences described.

I claim:

1. In a system for evacuating two side-by-side walled chambers, one of such chambers being arranged for evacuation while the other has the pressure therein restored to ambient pressure following reduction therein to a pressure less than ambient:
   a. a pair of side-by-side walled evacuation chambers having a common wall therebetween;
   b. a passageway with a port in said common wall and connected selectively to one or the other of said walled evacuation chambers;
   c. a closure for a chamber and said port movable between positions where one or the other of said chambers and said port are connected;
   d. circuit means operable upon movement of said closure to either closing position for connecting said port and its connected chamber to a source for reducing pressure in said connected chamber below ambient.

2. In a system according to claim 1 wherein said circuit means includes means for reducing the pressure in said connected chamber at a varying rate to control the reduction of pressure in said connected chamber.

3. In a system according to claim 2 wherein said last named means includes a flow throttling valve.

4. In a system according to claim 1 wherein said circuit means includes means for restoring the pressure in said connected chamber to ambient at the conclusion of an evacuation within said connected chamber.

5. In a system according to claim 1 wherein said closure is slidable between said positions.

6. A system according to claim 1 wherein the movement of said closure to closing position initiates said circuit means.

7. A system according to claim 6 wherein the subatmospheric pressure within the closed chamber is released to ambient for movement of the closure to closing position for the then open chamber.

* * * * *